US009137617B2

(12) United States Patent
Lee et al.

(10) Patent No.: US 9,137,617 B2
(45) Date of Patent: Sep. 15, 2015

(54) CORRELATION PARAMETER TRANSMITTING IN AN ENCODING APPARATUS AND DECODING APPARATUS

(75) Inventors: Nam-suk Lee, Suwon-si (KR); Chul-Woo Lee, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 421 days.

(21) Appl. No.: 13/614,920

(22) Filed: Sep. 13, 2012

(65) Prior Publication Data

US 2013/0064377 A1 Mar. 14, 2013

(30) Foreign Application Priority Data

Sep. 14, 2011 (KR) ..... 10-2011-0092561

(51) Int. Cl.
*H04R 5/00* (2006.01)
*H04S 1/00* (2006.01)

(52) U.S. Cl.
CPC ..... *H04S 1/00* (2013.01); *H04S 2400/03* (2013.01); *H04S 2420/07* (2013.01)

(58) Field of Classification Search
CPC ..... G10L 19/008
USPC ..... 381/17–18, 20, 22–23, 119
See application file for complete search history.

(56) References Cited

U.S. PATENT DOCUMENTS

| | | | | |
|---|---|---|---|---|
| 6,169,973 | B1 * | 1/2001 | Tsutsui et al. | 704/500 |
| 2009/0164227 | A1 * | 6/2009 | Oh et al. | 704/500 |
| 2009/0210234 | A1 * | 8/2009 | Sung et al. | 704/500 |
| 2010/0153119 | A1 * | 6/2010 | Lee et al. | 704/500 |
| 2011/0040566 | A1 * | 2/2011 | Moon et al. | 704/500 |

* cited by examiner

*Primary Examiner* — Paul S Kim
*Assistant Examiner* — Katherine Faley
(74) *Attorney, Agent, or Firm* — Sughrue Mion, PLLC

(57) ABSTRACT

An encoding apparatus includes a down-mixing unit for down-mixing first and second input signals, and controlling a spatial parameter comprising or not comprising a first parameter which indicates a correlation between the first and second input signals to be transmitted to a decoding apparatus according to whether any one of the first and second input signals has a magnitude that is equal to or less than a predetermined threshold value; and a transmitting unit for transmitting the spatial parameter to the decoding apparatus.

18 Claims, 7 Drawing Sheets

CORRELATION PARAMETER TRANSMITTING IN AN ENCODING APPARATUS AND DECODING APPARATUS

CROSS-REFERENCE TO RELATED PATENT APPLICATION

This application claims the benefit of Korean Patent Application No. 10-2011-0092561, filed on Sep. 14, 2011, in the Korean Intellectual Property Office, the disclosure of which is incorporated herein by reference in its entirety.

BACKGROUND

1. Field

The present inventive concept relates to a signal processing method of transmitting and receiving a spatial parameter, and an encoding and decoding apparatus. More particularly, the inventive concept relates to a signal processing method of transmitting and receiving a spatial parameter used to encode a stereo signal to a mono signal and to restore the mono signal to the stereo signal.

2. Description of the Related Art

An encoding and decoding apparatus for multi-channel input and output, encode and decode an audio signal including voice, music, or the like by using a predetermined codec, and transceive a decoded signal. With respect to an audio codec, if there is one input/output channel, it is referred to as a mono-channel, and if there are two input/output channels, they are referred to as stereo channels. A representative example of audio coding for processing a stereo signal includes parametric stereo coding.

According to the parametric stereo coding, stereo signals which correspond to two channels are received and down-mixed, so that a mono signal is generated. Then, a down-mixed mono signal is encoded and transmitted to a decoding apparatus, or the like. An encoding apparatus generates a predetermined parameter used to restore the down-mixed mono signal to the original stereo signals, encodes the predetermined parameter, includes the encoded predetermined parameter and the encoded mono signal in a transport stream, and then transmits them to the decoding apparatus.

Here, the predetermined parameter may indicate a spatial parameter. Also, in a case where the original stereo signals are divided into a plurality of sub-frequency bands and then are encoded, the spatial parameter is transmitted from each of the plurality of sub-frequency bands.

In order to allow the mono signal to be restored exactly to the original stereo signals, there is an increase in an amount of data of the spatial parameter. This is because the spatial parameter has to include detailed information regarding the original stereo signals, and detailed information regarding a correlation between the original stereo signals and the mono signal.

However, data exchange between the encoding apparatus and the decoding apparatus is performed using limited bandwidth, so that, when the amount of data of the spatial parameter is increased, the efficiency of use of the bandwidth deteriorates, and a speed of the data exchange between the encoding apparatus and the decoding apparatus is decreased.

Also, if the amount of data of the spatial parameter is decreased in order to increase the use efficiency of the bandwidth and the speed of the data exchange, the mono signal may not be restored exactly to the original stereo signal.

Thus, there is a requirement to provide a method and apparatus for increasing the efficiency of use of the bandwidth and the speed of data exchange, without deteriorating the exactness of the restoration.

SUMMARY

The present inventive concept provides a signal processing method capable of decreasing an amount of data exchange, and an encoding and decoding apparatus.

In particular, the present inventive concept provides a signal processing method capable of decreasing the amount of data exchange between an encoding apparatus and a decoding apparatus, without deteriorating the quality of restored data.

According to an aspect of the present inventive concept, there is provided an encoding apparatus including a down-mixing unit for down-mixing first and second input signals, and controlling a spatial parameter including or not including a first parameter which indicates a correlation between the first and second input signals to be transmitted to a decoding apparatus, according to whether any one of the first and second input signals has a magnitude that is equal to or less than a predetermined threshold value; and a transmitting unit for transmitting the spatial parameter to the decoding apparatus.

The down-mixing unit may determine whether any one of the first and second input signals has a magnitude that is equal to or less than the predetermined threshold value, and controls the spatial parameter to be transmitted to the decoding apparatus, wherein the spatial parameter includes or does not include the first parameter according to a result of the determination.

If any one of the first and second input signals has a magnitude that is equal to or less than the predetermined threshold value, the down-mixing unit may control the spatial parameter not including the first parameter to be transmitted to the decoding apparatus.

If none of the first and second input signals have a magnitude that is equal to or less than the predetermined threshold value, the down-mixing unit may control the spatial parameter including the first parameter to be transmitted to the decoding apparatus.

The down-mixing unit may include a spatial parameter generating unit that generates a second parameter which indicates a signal level difference between the first and second input signals, and which generates the spatial parameter including the second parameter and including or not including the first parameter.

The encoding apparatus may further include a band dividing unit for dividing the first and second input signals into a plurality of divided first and second input signals which correspond to a plurality of sub-frequency bands, respectively, and the down-mixing unit may further include a down-mixer for down-mixing the first and second input signals that are divided according to each of the plurality of sub-frequency bands.

The first parameter may include at least one of an inter channel correlation (ICC) parameter, an overall phase difference (OPD) parameter, and an inter phase difference (IPD) parameter.

The transmitting unit may include a stream generating unit for generating a transport stream including the spatial parameter and a signal obtained by down-mixing the first and second input signals, and outputting the transport stream to the decoding apparatus.

According to another aspect of the present inventive concept, there is provided a decoding apparatus for receiving a down-mixed signal obtained by down-mixing first and second input signals, and a spatial parameter from an encoding apparatus, the decoding apparatus including a spatial parameter decoding unit for decoding the spatial parameter including or not including a first parameter which indicates a correlation between the first and second input signals according to whether any one of the first and second input signals has a magnitude that is equal to or less than a predetermined threshold value; and an up-mixing unit for decoding the down-mixed signal, and restoring the first and second input signals by using the spatial parameter and the down-mixed signal.

According to another aspect of the present inventive concept, there is provided a signal processing method including operations of generating a down-mixed signal by down-mixing first and second input signals, wherein the generating is performed by an encoding apparatus; and transmitting a spatial parameter to a decoding apparatus, wherein the spatial parameter includes or does not include a first parameter which indicates a correlation between the first and second input signals according to whether any one of the first and second input signals has a magnitude that is equal to or less than a predetermined threshold value.

An exemplary embodiment of the inventive concept further includes an encoding apparatus including a down-mixer which down-mixes first and second input signals; the down-mixer controlling a spatial parameter which comprises or does not comprise a first parameter which indicates a correlation between the first and second input signals to be transmitted; and a transmitter for transmitting the spatial parameter to a decoding apparatus. The correlation is according to whether any one of the first and second input signals has a magnitude that is equal to or less than a predetermined threshold value. A further exemplary embodiment includes a decoding apparatus including a spatial parameter decoder which decodes a down mixed signal and a spatial parameter which comprises or does not comprise a first parameter which indicates a correlation between first and second input signals, wherein the correlation is according to whether any one of the first and second input signals has a magnitude that is equal to or less than a predetermined threshold value; and an up-mixer which restores the first and second input signals using the spatial parameter and the down-mixed signal.

BRIEF DESCRIPTION OF THE DRAWINGS

The above and other features and advantages of the present inventive concept will become more apparent by describing in detail exemplary embodiments thereof with reference to the attached drawings in which.

DETAILED DESCRIPTION

Hereinafter, a signal processing method and an encoding and decoding apparatus according to one or more aspects of the present inventive concept will be described in detail by explaining exemplary embodiments of the inventive concept, with reference to the attached drawings.

Expressions such as "at least one of," when preceding a list of elements, modify the entire list of elements and do not modify the individual elements of the list.

A spatial parameter may broadly include a parameter which indicates a difference in signal level between stereo signals, and a parameter which indicates a correlation between the stereo signals.

Hereinafter, the parameter which indicates the difference in signal level between the stereo signals is referred to as 'first parameter.' The first parameter may include a channel level difference (CLD) parameter. Also, the first parameter may directly include information regarding signal levels of input stereo signals.

Hereinafter, the parameter which indicates the correlation between the stereo signals is referred to as 'second parameter.' The second parameter may include at least one of an inter channel correlation (ICC) parameter, an overall phase difference (OPD) parameter, and an inter phase difference (IPD) parameter.

Figure 1:
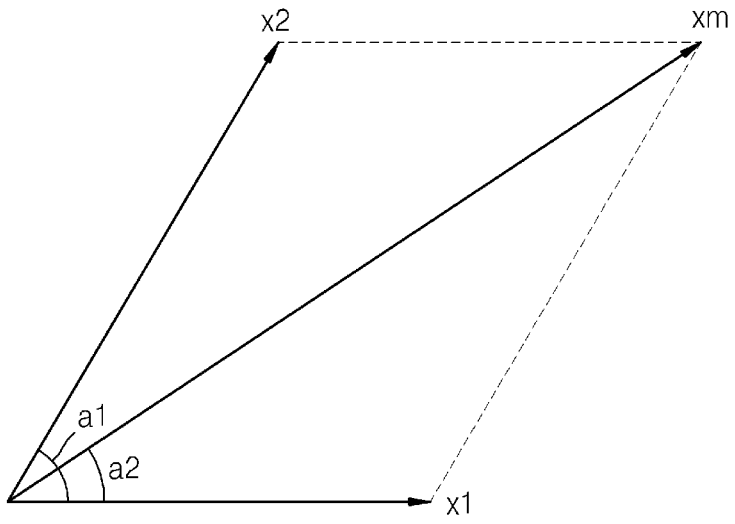
FIG. 1 is a diagram illustrating stereo signals and a mono signal.

FIG. 1 is a diagram illustrating stereo signals and a mono signal.

Referring to FIG. 1, x1 and x2 signals indicate the stereo signals. For example, the x1 signal may be an L-channel stereo signal, and the x2 signal may be an R-channel stereo signal. As illustrated in FIG. 1, xm, which is the mono signal generated by down-mixing the stereo signals of two channels, may indicate a summation of vectors of the x1 and x2 signals.

A correlation between the stereo signals may indicate a phase difference or a phase similarity between the stereo signals. The OPD parameter indicates a phase difference (i.e., a2) between the mono signal and the x1 signal that is the L-channel stereo signal. The IPD parameter indicates a phase difference (i.e., a1) between the stereo signals. Also, the ICC parameter indicates a similarity between the stereo signals of the two channels, and may have a cosine (i.e., a1) value.

Figure 2:
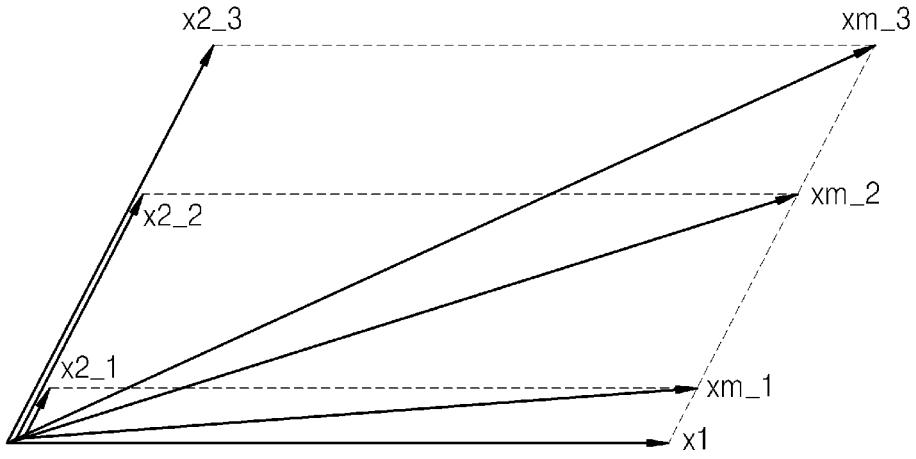
FIG. 2 is another diagram illustrating stereo signals and mono signals.

FIG. 2 is another diagram illustrating stereo signals and mono signals.

In a case where two stereo signals are down-mixed to one mono signal, if a signal level of one of the two stereo signals is decreased, the mono signal becomes similar to the other one of the two stereo signals.

FIG. 2 corresponds to an example in which a signal level of an x1 channel that is an L-channel stereo signal from among two channel stereo signals is not changed whereas a signal level of an x2 channel that is an R-channel stereo signal is changed to x2_1, x2_2, and x2_3 signals.

In a case where the R-channel stereo signal is the x2_3 signal having a third level, the mono signal is xm_3. In a case where the R-channel stereo signal is the x2_2 signal having a second level, the mono signal is xm_2. Also, in a case where the R-channel stereo signal is the x2_1 signal having a first level due to a significant decrease in the signal level of the R-channel stereo signal, the mono signal is xm_1.

As illustrated in FIG. 2, as the signal level of the R-channel stereo signal is decreased, a signal level of the mono signal becomes similar to the signal level of the L-channel stereo signal. Also, as the signal level of the R-channel stereo signal is decreased, a phase difference between the signal levels of the mono signal and the L-channel stereo signal is decreased. In more detail, when the R-channel stereo signal is the x2_1 signal having the first level due to the significant decrease in the signal level of the R-channel stereo signal, a phase of the mono signal (i.e., xm_1) is very similar to a phase of the L-channel stereo signal (i.e., x1), and there is only a very small difference between the phases of the mono signal (i.e., xm_1) and the L-channel stereo signal (i.e., x1).

That is, when two stereo signals are down-mixed to one mono signal, if a signal level of one of the two stereo signals is decreased, a correlation between the two stereo signals is decreased. In this regard, according to one or more exemplary embodiments of the present inventive concept, whether to transmit a first parameter is determined in consideration of the signal levels of the two stereo signals. Accordingly, it is possible to decrease the data amount required to transmit a spatial parameter, and to improve the efficiency of use of a limited bandwidth.

Hereinafter, an encoding apparatus, a decoding apparatus, and a signal processing method according to one or more exemplary embodiments of the present inventive concept will be described with reference to FIGS. 3 through 10.

Figure 3:
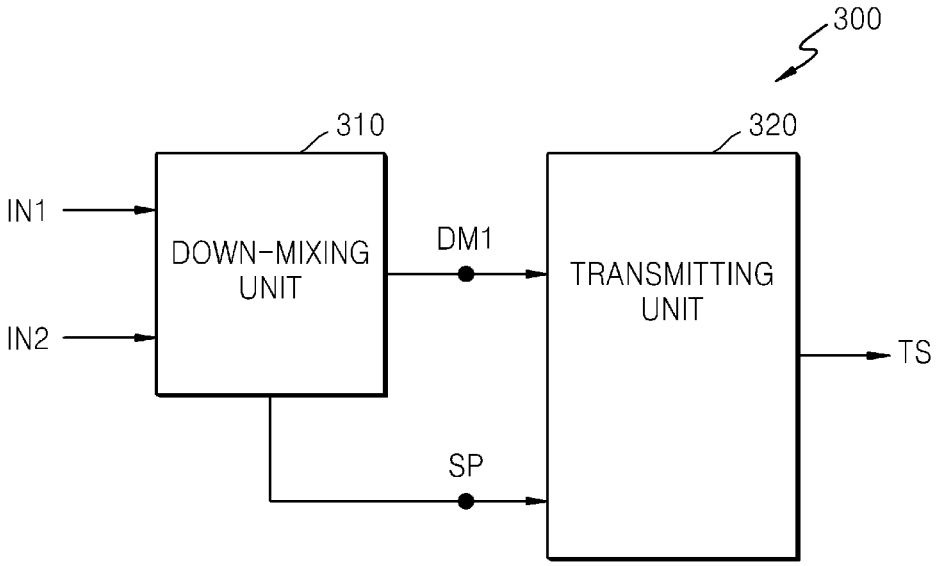
FIG. 3 is a block diagram illustrating an encoding apparatus according to an exemplary embodiment of the present inventive concept.

FIG. 3 is a block diagram illustrating an encoding apparatus 300 according to an exemplary embodiment of the present inventive concept.

Referring to FIG. 3, the encoding apparatus 300 includes a down-mixing unit 310 and a transmitting unit 320.

The down-mixing unit 310 down-mixes first and second input signals IN1 and IN2. Also, according to whether any one of the first and second input signals IN1 and IN2 has a magnitude that is equal to or less than a predetermined threshold value, the down-mixing unit 310 controls a spatial parameter SP, which includes or does not include a first parameter which indicates a correlation between the first and second input signals IN1 and IN2, to be transmitted to a decoding apparatus (not shown). Here, the first and second input signals IN1 and IN2 correspond to the aforementioned two channel stereo signals, and a down-mixed signal DM1 output from the down-mixing unit 310 corresponds to the aforementioned mono signal.

While the down-mixing unit 310 down-mixes the first and second input signals IN1 and IN2, the down-mixing unit 310 extracts the spatial parameter SP. The spatial parameter SP includes at least one of the aforementioned first and second parameters.

The transmitting unit 320 transmits the spatial parameter SP to the decoding apparatus. In particular, the transmitting unit 320 encodes the down-mixed signal DM1 and the spatial parameter SP, which are generated by the down-mixing unit 310, according to a predetermined standard, and formats encoded data into a transport stream TS. Then, the transmitting unit 320 transmits the formatted transport stream TS to the decoding apparatus.

Here, the predetermined threshold value indicates a signal level of an input signal which may be ignored when the mono signal is generated by a down-mixing operation. As illustrated in FIG. 2, in a case where the signal level of the mono signal (i.e., xm_1) becomes very similar to the signal level of the L-channel stereo signal (i.e., x1), and there is only a very small difference between the phases of the mono signal (i.e., xm_1) and the L-channel stereo signal (i.e., x1), the predetermined threshold value may be set to be similar to the signal magnitude of the R-channel stereo signal (i.e., x2_1).

The predetermined threshold value may be set as an optimized value in consideration of a product specification of the encoding apparatus 300. In particular, the predetermined threshold value may be set high so as to increase a bitrate, a use efficiency of a bandwidth or a speed of data exchange. Also, the predetermined threshold value may be set to be close to 0 so as to increase the exactness of restoration when a down-mixed signal is restored to the original stereo signals.

For example, in order to increase the exactness of restoration, the predetermined threshold value may be set as a maximum level of an analog input signal which becomes 0 when the analog input signal is quantized. If the predetermined threshold value is set as a quantization value of 0, although the first parameter is not transmitted to the decoding apparatus but the spatial parameter SP including only the second parameter is transmitted to the decoding apparatus, the original stereo signals may be exactly restored by using only the second parameter.

In particular, if any one of the first and second input signals IN1 and IN2 has a magnitude that is equal to or less than the predetermined threshold value, the down-mixing unit 310 may control the spatial parameter SP not including the first parameter to be transmitted to the decoding apparatus. Also, if none of the first and second input signals IN1 and IN2 have a magnitude that is equal to or less than the predetermined threshold value, the down-mixing unit 310 may control the spatial parameter SP including the first parameter to be transmitted to the decoding apparatus.

That is, if a magnitude of one input signal from among the first and second input signals IN1 and IN2 that are input during down-mixing is equal to or less than the predetermined threshold value, there is only a very small correlation between the one input signal and the other input signal. Thus, when a magnitude of the one input signal from among the first and second input signals IN1 and IN2 is equal to or less than the predetermined threshold value, the transmitting unit 320 transmits the spatial parameter SP not including the first parameter which indicates the correlation between the first and second input signals IN1 and IN2 to the decoding apparatus.

When a magnitude of the one input signal from among the first and second input signals IN1 and IN2 is equal to or less than the predetermined threshold value, the encoding apparatus 300 may decrease an amount of data transmission which corresponds to transmission of the first parameter. Accordingly, a bitrate, an efficiency of use of a bandwidth or a speed of data exchange may be increased.

Figure 4:
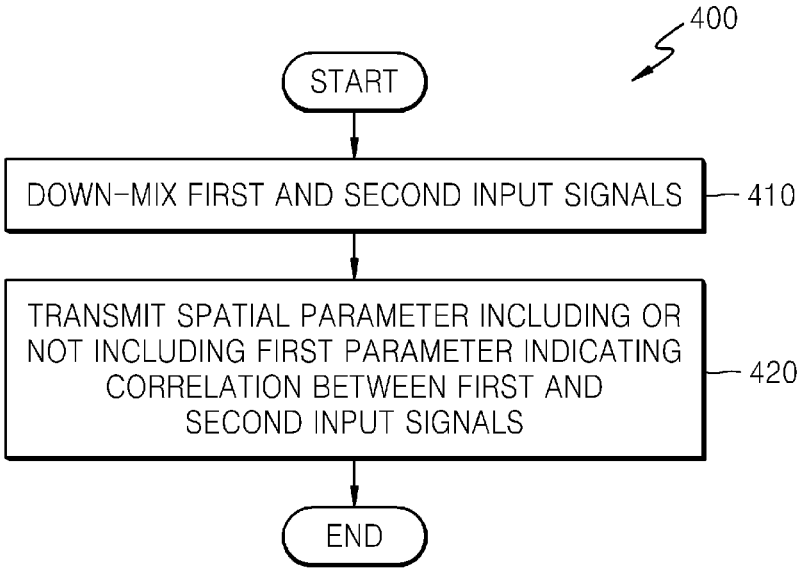
FIG. 4 is a flowchart of a signal processing method, according to an exemplary embodiment of the present inventive concept.

FIG. 4 is a flowchart of a signal processing method 400, according to an exemplary embodiment of the present inventive concept. The signal processing method 400 may be performed by the encoding apparatus 300 described with reference to FIG. 3. Also, operations involved in the signal processing method 400 are the same as operations performed by the encoding apparatus 300, respectively Thus, detailed descriptions, which are the same as the aforementioned contents with reference to FIG. 3, will be omitted here.

Referring to FIG. 4, the encoding apparatus 300 generates a down-mixed signal DM1 by down-mixing first and second input signals IN1 and IN2 (operation 410). Operation 410 may be performed by the down-mixing unit 310.

According to whether any one of the first and second input signals IN1 and IN2 has a magnitude that is equal to or less than a predetermined threshold value, a spatial parameter that includes or does not include a first parameter which indicates a correlation between the first and second input signals IN1 and IN2 is transmitted to a decoding apparatus (not shown) (operation 420). Operation 420 may be performed by the transmitting unit 320.

Figure 5:
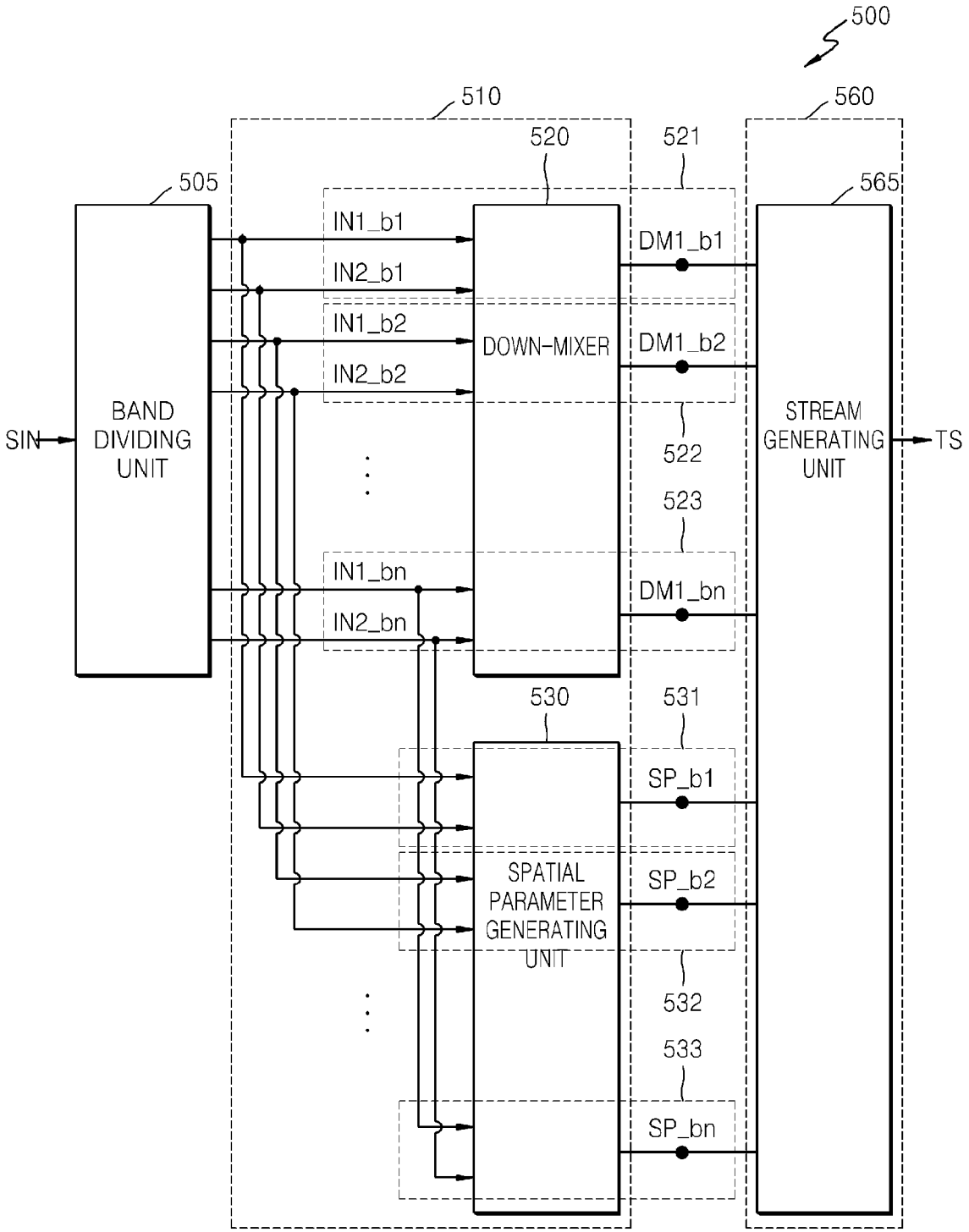
FIG. 5 is a block diagram illustrating an encoding apparatus according to another exemplary embodiment of the present inventive concept.

FIG. 5 is a block diagram illustrating an encoding apparatus 500 according to another exemplary embodiment of the present inventive concept. In the encoding apparatus 500, a down-mixing unit 510 and a transmitting unit 560 correspond to the down-mixing unit 310 and the transmitting unit 320 of FIG. 3, respectively. Thus, detailed descriptions, which are the same as the aforementioned contents with reference to FIG. 3, will be omitted here.

Referring to FIG. 5, the encoding apparatus 500 includes a band dividing unit 505, the down-mixing unit 510 and the transmitting unit 560. The down-mixing unit 510 may include a down-mixer 520 and a spatial parameter generating unit 530. Also, the transmitting unit 560 may include a stream generating unit 565.

The band dividing unit 505 receives a stereo signal SIN, divides the stereo signal SIN according to a plurality of sub-frequency bands and then outputs a plurality of sub-band signals. For example, the band dividing unit 505 divides the stereo signal SIN into a plurality of divided stereo signals which correspond to a plurality of sub-frequency bands, respectively. The stereo signal SIN corresponds to the first and second input signals IN1 and IN2 described with reference to FIG. 3. Thus, the stereo signal SIN may include an R-channel signal and an L-channel signal. Hereinafter, a sub-frequency band is referred to as 'sub-band'. FIG. 5 corresponds to an example in which the band dividing unit 505 divides the stereo signal SIN into first sub-band (b1) 521 through n sub-band (bn) 523 that are n sub-bands.

In particular, the band dividing unit 505 outputs first sub-band input signals IN1_b1 and IN2_b1, which corresponds to the first sub-band (b1) 521. Then, the band dividing unit 505 outputs second sub-band input signals IN1_b2 and IN2_b2, which corresponds to the second sub-band (b2) 522. Also, the band dividing unit 505 outputs n sub-band input signals IN1_bn and IN2_bn, which corresponds to the n sub-band (bn) 523.

The down-mixer 520 generates a down-mixed signal by down-mixing input signals. In more detail, the down-mixer 520 receives n pairs of stereo signals which correspond to the n sub-bands, and then generates n down-mixed signals which correspond to the n sub-bands. For example, the down-mixer 520 down-mixes the first sub-band input signals IN1_b1 and IN2_b1 that indicate the stereo signal SIN, and thus generates a first down-mixed signal DM1_b1 that corresponds to the first sub-band (b1) 521. Also, the down-mixer 520 generates second down-mixed signal DM1_b2 through n down-mixed signal DM1_bn that correspond to the second sub-band (b2) 522 through the n sub-band (bn) 523, respectively.

The spatial parameter generating unit 530 generates a second parameter which indicates a signal level difference between first and second input signals IN1_bi and IN2-bi. Then, the spatial parameter generating unit 530 generates a spatial parameter SP_bi that includes the second parameter, and includes or does not include the first parameter.

In particular, the spatial parameter generating unit 530 may receive n pairs of stereo signals that are input to the down-mixer 520 and corresponds to n sub-bands (e.g., sub-bands 531, 532, and 533), and may generate spatial parameters which correspond to the n sub-bands. Then, according to whether one of the first and second input signals IN1_bi and IN2-bi has a magnitude that is equal to or less than a predetermined threshold value, the spatial parameter generating unit 530 generates the spatial parameter SP_bi that includes or does not include the first parameter.

Also, the spatial parameter generating unit 530 may receive the n pairs of stereo signals which correspond to the n sub-bands, and then may generate the second parameter. Also, according to whether one of the first and second input signals IN1_bi and IN2-bi has a magnitude that is equal to or less than the predetermined threshold value, the spatial parameter generating unit 530 may not generate the first parameter.

The spatial parameter generating unit 530 transmits first spatial parameter SP_b1 through n spatial parameter SP_bn, which correspond to the first sub-band (b1) 521 through n sub-band (bn) 523, respectively, to the transmitting unit 560.

The stream generating unit 565 generates a transport stream TS by encoding and formatting received spatial parameters and down-mixed signals, and outputs the transport stream TS to a decoding apparatus (not shown).

In particular, the stream generating unit 565 encodes the received down-mixed signals with respect to sub-bands, and the received spatial parameters with respect to the sub-bands according to a predetermined standard. Then, the stream generating unit 565 may generate the transport stream TS including the encoded down-mixed signals and the encoded spatial parameters. The transport stream TS may include n down-mixed signals and n spatial parameters which correspond to the encoded n sub-bands, respectively.

Figure 6:
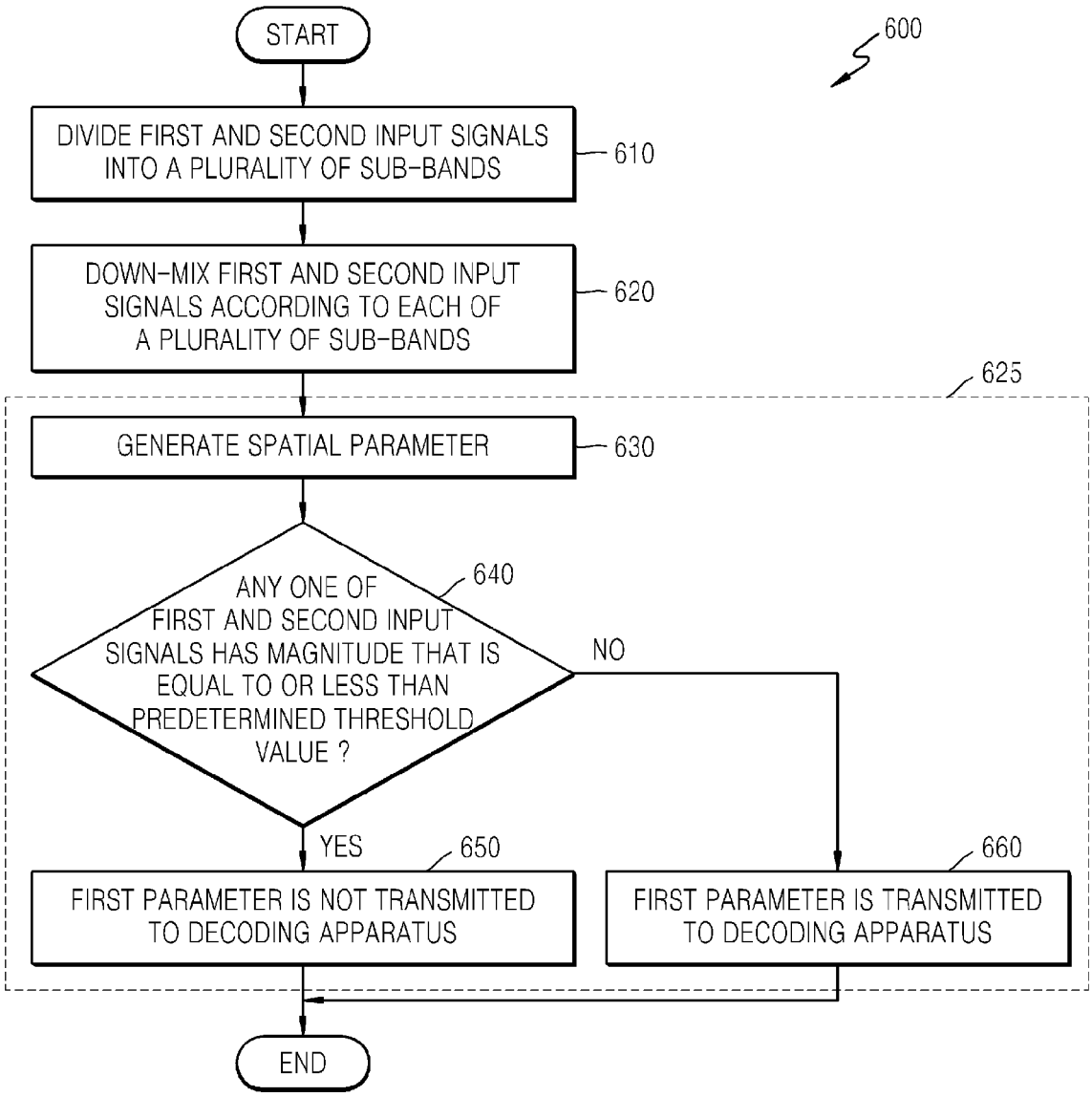
FIG. 6 is a flowchart of a signal processing method, according to another exemplary embodiment of the present inventive concept.

FIG. 6 is a flowchart of a signal processing method 600, according to another exemplary embodiment of the present inventive concept. The signal processing method 600 may be performed by the encoding apparatus 500 described with reference to FIG. 5. Also, operations involved in the signal processing method 600 are the same as operations performed by the encoding apparatus 500, respectively. Thus, detailed descriptions, which are the same as the aforementioned contents with reference to FIG. 5, will be omitted here. Also, operation 625 corresponds to operation 420 described with reference to FIG. 4 Thus, detailed descriptions, which are the same as the aforementioned contents with reference to FIG. 4, will be omitted here.

Referring to FIG. 6, the signal processing method 600 involves dividing the stereo signal SIN into the plurality of sub-bands (operation 610). Operation 610 may be performed by the band dividing unit 505.

The plurality of sub-band input signals (e.g., IN1_b1 and IN2_b1) that are divided according to the sub-bands, respectively, are down-mixed (operation 620). Operation 620 may be performed by the down-mixer 520.

The spatial parameter SP is generated (operation 630). Operation 630 may be performed by the spatial parameter generating unit 530.

Then, a determination is made as to whether any one of the first and second input signals IN1 and IN2 has a magnitude that is equal to or less than a predetermined threshold value (operation 640). In particular, a determination is made as to whether any one of the sub-band input signals (e.g., IN1_b1 and IN2_b1) has a magnitude that is equal to or less than the predetermined threshold value. Operation 640 may be performed by the down-mixing unit 510 and more particularly, may be performed by the down-mixer 520 or the spatial parameter generating unit 530.

According to a result of the determination in operation 640, the spatial parameter SP_bi that includes or does not include the first parameter may be transmitted to the decoding apparatus (operations 650 and 660). Operations 650 and 660 may be performed by the stream generating unit 565.

In particular, according to the result of the determination in operation 640, if any one of the sub-band input signals (e.g., IN1_b1 and IN2_b1) has a magnitude that is equal to or less than the predetermined threshold value, the spatial parameter that does not include the first parameter is transmitted to the decoding apparatus (operation 650). According to the result of the determination in operation 640, if none of the sub-band input signals (e.g., IN1_b1 and IN2_b1) have a magnitude that is equal to or less than the predetermined threshold value, the spatial parameter that includes the first parameter is transmitted to the decoding apparatus (operation 660).

Figure 7:
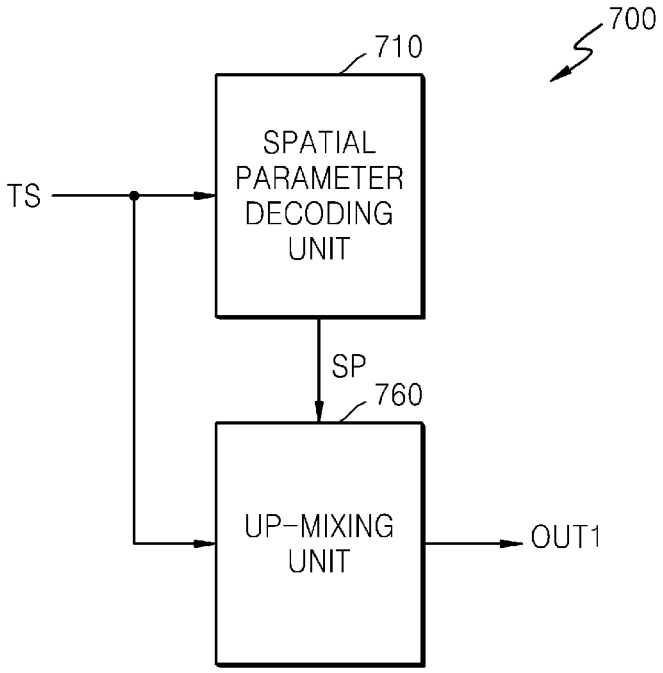
FIG. 7 is a block diagram of a decoding apparatus according to an exemplary embodiment of the present inventive concept.

FIG. 7 is a block diagram of a decoding apparatus 700 according to an exemplary embodiment of the present inventive concept.

Referring to FIG. 7, the decoding apparatus 700 includes a spatial parameter decoding unit 710 and an up-mixing unit 760.

The spatial parameter decoding unit 710 decodes a spatial parameter that includes or does not include a first parameter which indicates a correlation between first and second input signals, according to whether any one of the first and second input signals that have been input to one of the encoding apparatuses 300 and 500 has a magnitude that is equal to or less than a predetermined threshold value.

In particular, the spatial parameter decoding unit 710 receives the transport stream TS generated by one of the encoding apparatuses 300 and 500, and extracts the spatial parameters SP_bi which corresponds to the sub-bands, respectively. Then, the spatial parameter decoding unit 710 decodes the spatial parameters SP_bi which correspond, respectively to the sub-bands. The spatial parameters SP_bi that are input to and extracted by the spatial parameter decoding unit 710 are equal to the spatial parameters correspond to the sub-bands, respectively, which are generated by one of the transmitting units 360 and 560.

The up-mixing unit 760 decodes a down-mixed signal included in the transport stream TS. In more detail, the up-mixing unit 760 extracts the down-mixed signals DM1_bi, which correspond to the sub-bands, respectively, and are encoded by the transmitting unit 560, from the transport stream TS, and decodes the extracted down-mixed signals DM1_bi.

The up-mixing unit 760 restores first and second input signals IN1_bi and IN2_bi which correspond to the sub-bands, respectively, by using the spatial parameters SP_bi and the decoded down-mixed signals DM1_bi which are transmitted from the spatial parameter decoding unit 710, and then outputs an up-mixed signal OUT1. In particular, the up-mixing unit 760 may restore the first and second input signals IN1_bi and IN2_bi which correspond to the sub-bands, respectively, by performing an up-mixing operation on each of the sub-bands.

Figure 8:
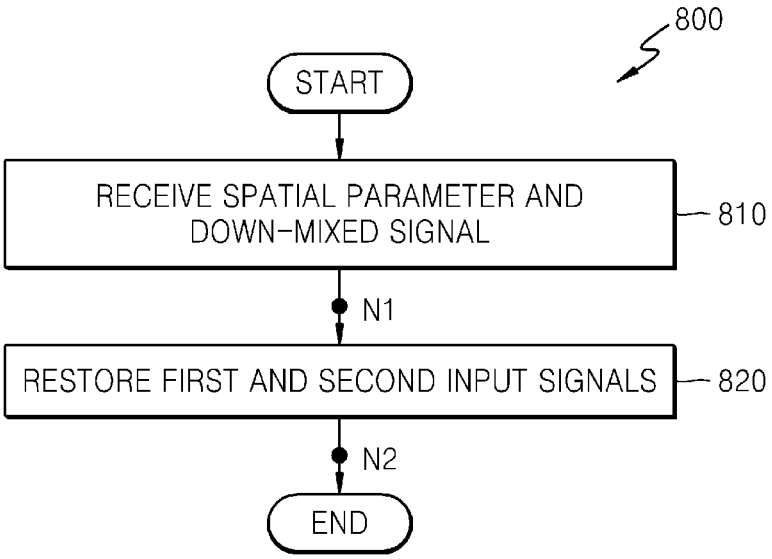
FIG. 8 is a flowchart of a signal processing method, according to an exemplary embodiment of the present inventive concept.

FIG. 8 is a flowchart of a signal processing method 800, according to an exemplary embodiment of the present inventive concept. The signal processing method 800 may be performed by the decoding apparatus 700 described with reference to FIG. 7. Also, operations involved in the signal processing method 800 are the same as operations performed respectively, by the decoding apparatus 700. Thus, detailed descriptions, which are the same as the aforementioned contents with reference to FIG. 7, will be omitted here.

Referring to FIG. 8, the transport stream TS including a spatial parameter and a down-mixed signal is received (operation 810). Operation 810 is performed by the decoding apparatus 700. In particular, by the spatial parameter decoding unit 710 and the up-mixing unit 760.

The first and second input signals IN1 and IN2 are restored by using the spatial parameter and the down-mixed signal included in the transport stream TS (operation 820). A detailed configuration of operation 820 will be described below, in detail, with reference to FIG. 10.

Figure 9:
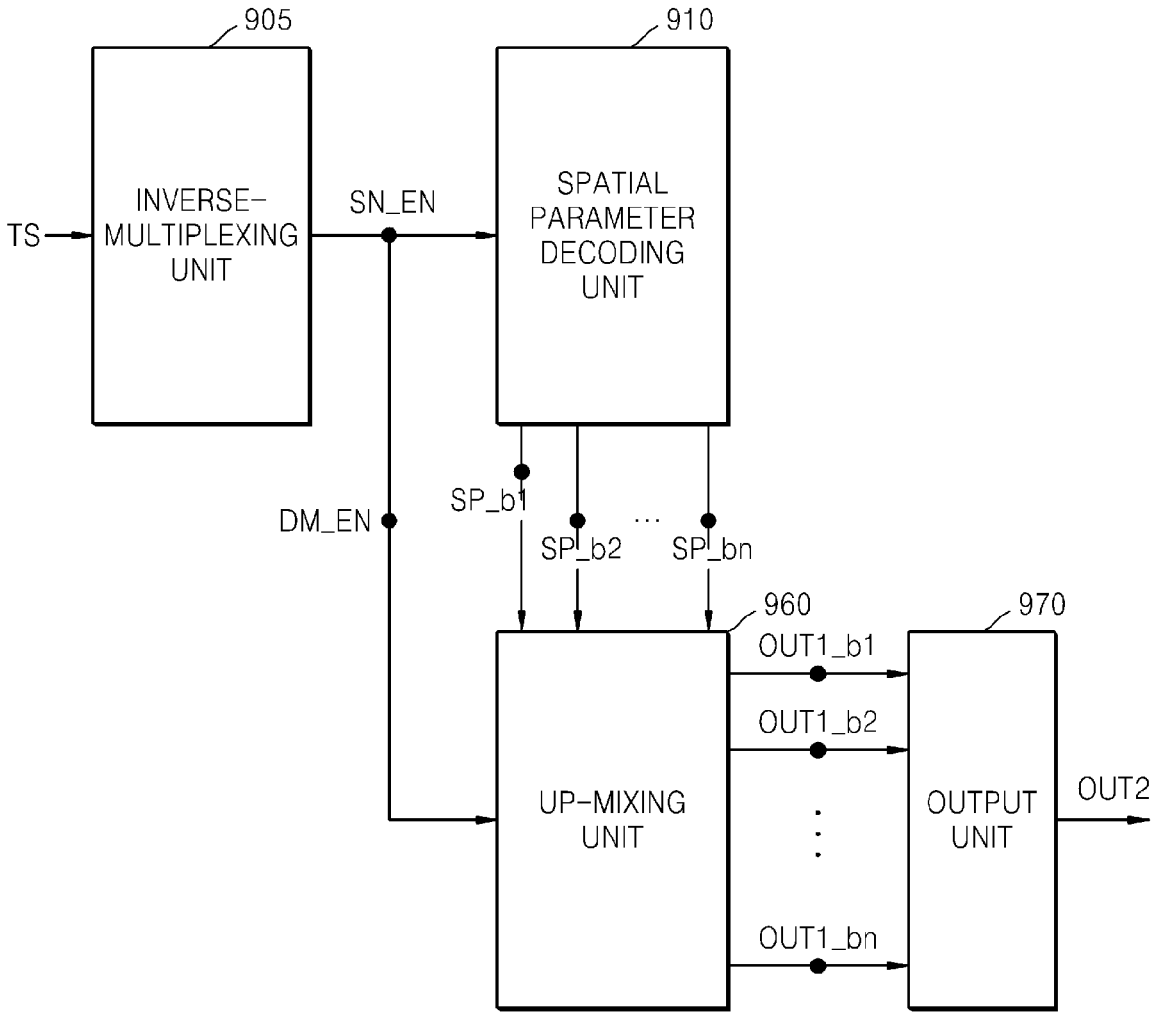
FIG. 9 is a block diagram of a decoding apparatus according to another exemplary embodiment of the present inventive concept.
Figure 10:
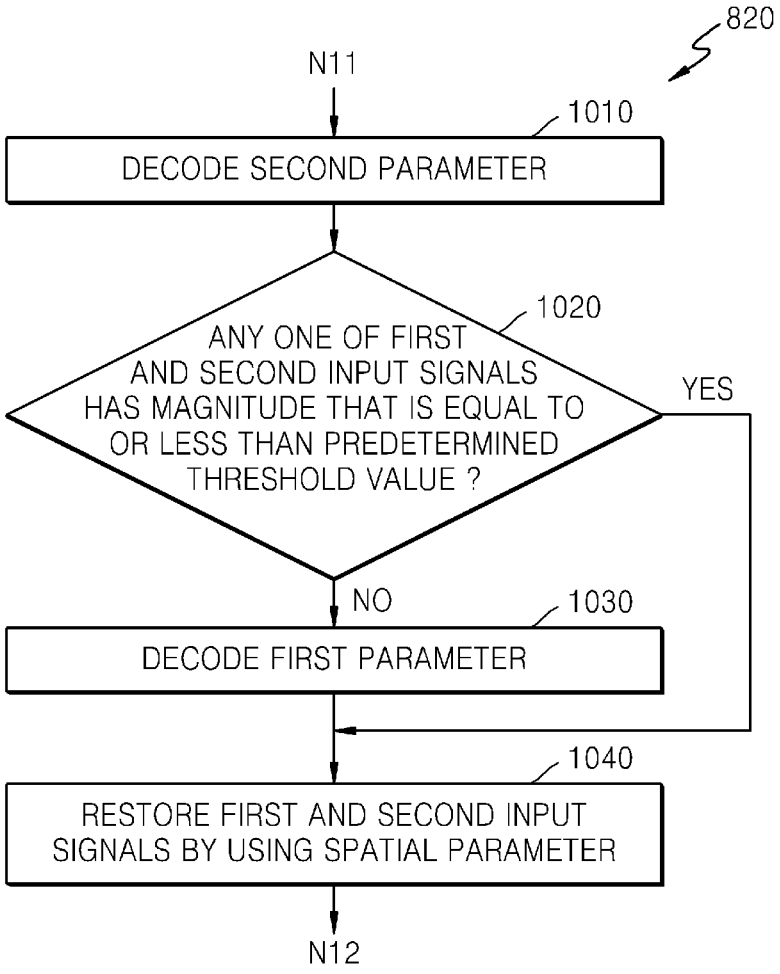
FIG. 10 is a flowchart of a signal processing method, according to another exemplary embodiment of the present inventive concept.

FIG. 9 is a block diagram of a decoding apparatus 900 according to another exemplary embodiment of the present inventive concept. FIG. 10 is a flowchart of a signal processing method, according to another exemplary embodiment of the present inventive concept. FIG. 10 illustrates in detail operation 820 of FIG. 8, and N11 and N12 points of FIG. 10 respectively correspond to N1 and N2 points of FIG. 8.

In the decoding apparatus 900 of FIG. 9, the spatial parameter decoding unit 910 and the up-mixing unit 960 correspond to the spatial parameter decoding unit 710 and the up-mixing unit 760 of FIG. 7, respectively. Thus, detailed descriptions, which are the same as the aforementioned contents with reference to FIG. 7, will be omitted here.

An operational configuration of the decoding apparatus 900 includes the same technical features as those of operations to be described with reference to FIG. 10 Thus, hereinafter, a description of the decoding apparatus 900 and detailed descriptions regarding operation 820 of FIG. 8 will be provided.

Referring to FIG. 9, the decoding apparatus 900 includes an inverse-multiplexing unit 905, the spatial parameter decoding unit 910, the up-mixing unit 960, and an output unit 970.

The inverse-multiplexing unit 905 receives the transport stream TS transmitted from one of the encoding apparatuses 300 and 500. Then, the inverse-multiplexing unit 905 divides a plurality of pieces of data signal, and signals regarding a spatial parameter, which are included in the transport stream TS. In particular, the data signal is a signal obtained by down-mixing and encoding a stereo signal, and becomes an audio signal to be actually reproduced as a sound signal.

Here, signals SP_EN output from the inverse-multiplexing unit 905 relate to the spatial parameter, which is generated by one of the down-mixing units 310 and 510 of one of the encoding apparatuses 300 and 500 and then is encoded by one of the transmitting units 360 and 560 of one of the encoding apparatuses 300 and 500, and are transmitted to the spatial parameter decoding unit 910. Also, a plurality of pieces of data signal DM_EN output from the inverse-multiplexing unit 905 relate to a down-mixed signal, which is generated by one of the down-mixing units 310 and 510 of one of the encoding apparatuses 300 and 500 and then is encoded by one of the transmitting units 360 and 560 of one of the encoding apparatuses 300 and 500, and are transmitted to the up-mixing unit 960.

The spatial parameter decoding unit 910 extracts and decodes spatial parameters SP_b1 through SP_bn, which correspond to the sub-bands, respectively, from the received signals SP_EN. The spatial parameters SP_b1 through SP_bn that correspond to the sub-bands, respectively, and are output from the spatial parameter decoding unit 910 are the same as the first spatial parameter SP_b1 through n spatial parameter SP_bn that correspond to the sub-bands, respectively, and are output from the spatial parameter generating unit 530.

In particular, the spatial parameter decoding unit 910 extracts a second parameter from the signals SP_EN regarding the spatial parameter, and decodes the second parameter (operation 1010).

The spatial parameter decoding unit 910 determines whether any one of first and second input signals IN1_bi and IN2_bi has a magnitude that is equal to or less than a predetermined threshold value, by using the second parameter decoded in operation 1010 (operation 1020). In particular, the second parameter includes information which indicates a signal level difference between the first and second input signals IN1_bi and IN2_bi with respect to each of the sub-bands, and by analyzing the signal level difference, it is possible to know the magnitudes of the first and second input signals IN1_bi and IN2_bi. Thus, the determination may be performed by using the second parameter.

According to a result of the determination in operation 1020, if any one of the first and second input signals IN1_bi and IN2_bi has a magnitude that is equal to or less than the predetermined threshold value, the spatial parameter decoding unit 910 does not decode a first parameter and proceeds to operation 1040. However, according to the result of the determination in operation 1020, if none of the first and second input signals IN1_bi and IN2_bi have a magnitude that is equal to or less than the predetermined threshold value, the spatial parameter decoding unit 910 decodes the first parameter (operation 1030).

Operations 1010 through 1030 are performed for each of the sub-bands.

The spatial parameter decoding unit 910 transmits the spatial parameters SP_b1 through SP_bn, which correspond to the sub-bands, respectively, includes the second parameter, and includes or does not include the first parameter according to the decoding operations in operations 1010 through 1030, to the up-mixing unit 960.

The up-mixing unit 960 decodes the plurality of pieces of data signal DM_EN, and extracts down-mixed signals that correspond to the sub-bands, respectively. Then, the up-mixing unit 960 restores the first and second input signals IN1_bi and IN2_bi with respect to each of the sub-bands by using the down-mixed signals, and the spatial parameters SP_b1 through SP_bn that correspond to the sub-bands, respectively, and are transmitted from the spatial parameter decoding unit 910. The up-mixing unit 960 transmits restored signals OUT1_b1 through OUT1_bn with respect to each of the sub-bands, which correspond to the first and second input signals IN1_bi and IN2_bi with respect to each of the sub-bands, to the output unit 970 (operation 1040).

Also, the output unit 970 generates the restored signals OUT1_b1 through OUT1_bn with respect to each of the sub-bands as a frequency-synthesized signal OUT2. Accordingly, an output signal OUT2 from the output unit 970 may identically correspond to the stereo signal (i.e., IN1 and IN2, or SIN) that is originally input to one of the encoding apparatuses 300 and 500.

The signal processing method, the encoding apparatus thereof, and the decoding apparatus thereof according to the one or more exemplary embodiments of the present inventive concept may decrease an amount of data transmission which corresponds to transmission of a first parameter which indicates a correlation between two stereo signals, when a magnitude of any one of the two stereo signals of the two channels is equal to or less than a predetermined threshold value. Accordingly, a bitrate, an efficiency of use of a bandwidth, or a speed of data exchange may be increased.

The invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, etc. The computer readable recording medium can also be distributed over network coupled computer systems so that the computer readable code is stored and executed in a distributed fashion.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An encoding apparatus comprising:

a down-mixer which down-mixes first and second input signals, and controls a spatial parameter to include a first parameter indicating a correlation between the first and second input signals according to whether any one of the first and second input signals has a magnitude that is equal to or less than a predetermined threshold value; and a transmitter which transmits the spatial parameter to a decoding apparatus, wherein, if any one of the first and second input signals has a magnitude that is equal to or less than the predetermined threshold value, the transmitter does not transmit the first parameter to the decoding apparatus.

2. The encoding apparatus of claim 1, wherein, if both of the first and second input signals have a magnitude that is greater than the predetermined threshold value, the transmitter transmits the first parameter to the decoding apparatus.

3. The encoding apparatus of claim 1, wherein the down-mixer comprises a spatial parameter generator that generates a second parameter indicating a signal level difference between the first and second input signals, and generates the spatial parameter comprising the second parameter.

4. The encoding apparatus of claim 3, further comprising a band divider which divides the first and second input signals into a plurality of divided first and second input signals which respectively correspond to a plurality of sub-frequency bands, wherein the down-mixer down-mixes the divided first and second input signals.

5. The encoding apparatus of claim 1, wherein the first parameter comprises at least one of an inter channel correlation parameter, an overall phase difference parameter, and an inter phase difference parameter.

6. The encoding apparatus of claim 1, wherein the transmitter comprises a stream generator which generates a transport stream comprising the spatial parameter and a down-mixed signal obtained by down-mixing the first and second input signals, and outputs the transport stream to the decoding apparatus.

7. A decoding apparatus for receiving a transport stream comprising a down-mixed signal obtained by down-mixing first and second input signals from an encoding apparatus and a spatial parameter, the decoding apparatus comprising:

a spatial parameter decoder which decodes the spatial parameter; and an up-mixer which decodes the down-mixed signal, and restores the first and second input signals using the spatial parameter and the down-mixed signal, wherein the spatial parameter decoder decodes a first parameter included in the spatial parameter, which indicates a correlation between the first and second input signals, according to whether any one of the first and second input signals has a magnitude that is equal to or less than a predetermined threshold value, and wherein the spatial parameter decoder does not decode the first parameter if any one of the first and second input signals has a magnitude that is equal to or less than the predetermined threshold value.

8. The decoding apparatus of claim 7, wherein the spatial parameter decoder decodes the first parameter if both of the first and second input signals have a magnitude that is greater than the predetermined threshold value.

9. The decoding apparatus of claim 7, wherein the spatial parameter decoder extracts a second parameter indicating a signal level difference between the first and second input signals from the spatial parameter, and decodes the second parameter, and the spatial parameter decoder determines by using the second parameter, whether any one of the first and second input signals has a magnitude that is equal to or less than the predetermined threshold value.

10. A signal processing method comprising:

generating, by an encoding apparatus, a down-mixed signal by down-mixing first and second input signals; and generating and transmitting a spatial parameter to a decoding apparatus, wherein the spatial parameter including a first parameter, which indicates a correlation between the first and second input signals, is transmitted according to whether any one of the first and second input signals has a magnitude that is equal to or less than a predetermined threshold value, wherein the transmitting of the spatial parameter comprises not transmitting the first parameter to the decoding apparatus, if any one of the first and second input signals has a magnitude that is equal to or less than the predetermined threshold value.

11. The signal processing method of claim 10, wherein the transmitting of the spatial parameter comprises transmitting the first parameter to the decoding apparatus, if both of the first and second input signals have a magnitude that is greater than the predetermined threshold value.

12. The signal processing method of claim 10, further comprising:

generating the spatial parameter which comprises a second parameter indicating a signal level difference between the first and second input signals; and determining whether any one of the first and second input signals has a magnitude that is equal to or less than the predetermined threshold value, wherein the transmitting the spatial parameter comprises transmitting the second parameter.

13. The signal processing method of claim 10, wherein the down-mixing comprises:

dividing the first and second input signals into a plurality of divided first and second input signals which respectively correspond to a plurality of sub-frequency bands; and down-mixing the divided first and second input signals.

14. The signal processing method of claim 10, further comprising receiving, by the decoding apparatus, the down-mixed signal and the spatial parameter; and restoring the first and second input signals by using the down-mixed signal and the spatial parameter.

15. The signal processing method of claim 14, wherein the restoring of the first and second input signals comprises:

decoding the first parameter.

16. The signal processing method of claim 15, wherein the decoding of the first parameter comprises:

decoding the first parameter, if both of the first and second input signals have a magnitude that is greater than the predetermined threshold value.

17. An encoding apparatus comprising:

a down-mixer which down-mixes first and second input signals, and generates a spatial parameter which comprises a first parameter indicating a correlation between the first and second input signals to be transmitted; and a transmitter for transmitting the spatial parameter to a decoding apparatus, wherein, if any one of the first and second input signals has a magnitude that is equal to or less than a predetermined threshold value, the transmitter does not transmit the first parameter to the decoding apparatus.

18. A decoding apparatus comprising:

a spatial parameter decoder which decodes a down-mixed signal and a spatial parameter which comprises a first parameter indicating a correlation between first and second input signals; and an up-mixer which restores the first and second input signals using the spatial parameter and the down-mixed signal, wherein the spatial parameter decoder does not decode the first parameter if any one of the first and second input signals has a magnitude that is equal to or less than the predetermined threshold value.

* * * * *